US005269112A

United States Patent [19]

Weinrub et al.

[11] Patent Number: 5,269,112

[45] Date of Patent: Dec. 14, 1993

[54] PORTABLE DISPLAY ASSEMBLY

[76] Inventors: Leonard Weinrub, 282 NW. 122nd Terr.; Martin Lederman, 423 NW. 113th Ave., both of Coral Springs, Fla. 33071

[21] Appl. No.: 741,755

[22] Filed: Aug. 7, 1991

[51] Int. Cl.[5] ..... E04H 12/18

[52] U.S. Cl. ..... 52/646; 40/610; 211/189

[58] Field of Search ..... 52/109, 638, 646, 648; 40/610; 211/189, 191, 194

[56] References Cited

U.S. PATENT DOCUMENTS

| | | | |
|---|---|---|---|
| 2,626,189 | 1/1953 | Brown | 52/638 |
| 3,221,837 | 12/1965 | Fisher | 52/646 |
| 4,001,987 | 1/1977 | Coulthard | 52/79.9 |
| 4,026,079 | 5/1977 | Morris | 52/122 |
| 4,095,387 | 6/1978 | Loewe | 52/645 |
| 4,512,097 | 4/1985 | Zeigler | 40/611 |
| 4,658,560 | 4/1987 | Beaulieu | 52/646 |
| 4,800,663 | 1/1989 | Zeigler | 40/610 |
| 4,809,471 | 3/1989 | Wichman et al. | 52/109 |
| 4,888,895 | 12/1989 | Kemeny | 40/610 |

*Primary Examiner*—Carl D. Friedman
*Assistant Examiner*—Matthew E. Leno
*Attorney, Agent, or Firm*—Malloy & Malloy

[57] ABSTRACT

A portable display assembly for use in displaying a variety of articles on a wall structure thereof, being structured for easy assembly and disassembly to facilitate transport between different use locations. The display assembly includes a plurality of vertical frame units which are adapted to be interconnected at spaced intervals by scissor connectors. The scissor connectors each include a pair of elongate, rigid elements pivotally attached at mid-portions thereof forming oppositely disposed scissor arms, wherein each pair of scissor arms is structured for attachment to a respective one of adjacently positioned vertical frame units in such a manner so as to position the adjacent frame units in either a parallel orientation or one of a plurality of angled orientations relative to one another. In this manner, a wall frame structure of virtually any desired size, shape and configuration can be assembled, to which may be attached decorative background panels, shelves, and other display material.

20 Claims, 9 Drawing Sheets

PORTABLE DISPLAY ASSEMBLY

BACKGROUND OF THE INVENTION

1. Field of the Invention

This invention relates to a portable display assembly adapted to be easily transported and assembled to provide a sturdy wall structure of any desired size and configuration for displaying a variety of items thereon.

2. Description of the Related Art

In trade shows, such as boat shows, clothing shows, appliance shows and the like, it is generally required that a manufacturer or business who is presenting goods or services in the show have a display booth constructed within a certain allotted space. Usually, the manufacturer will contract a display company, which may have some connection with the convention hall in which the show is being held, to construct a display structure within a rented space of approximately 100 to 200 square feet. The display structure usually consists of at least a back wall and sometimes side walls, wherein a display facing or backdrop is hung or tacked thereto. The manufacturer may then display his goods on the wall or simply hang pictures or photographs thereon, illustrating the various products being offered for sale by the manufacturer in the trade show.

Due to the considerable expense involved in having a display stand constructed, and as a result of the frequency of trade shows, seminars and like events, many manufacturers and businesses have custom display units constructed so that they may take their display stands from one trade show to another. Presently, there are a number of pop-up type assemblies, such as those disclosed in the patents to Kemeny, U.S. Pat. No. 4,888,895, and Zeigler, U.S. Pat. No. 4,800,663, which is available for sale to businesses. These type of display assemblies are generally constructed of a fiberglass mesh material with telescopic rods which form a somewhat semicircular wall onto which the display facing is hung. These assemblies, which are designed to be very lightweight, are not adapted for hanging relatively heavy products such as computers, camera equipment, and the like thereon. Further, their size and shape is fixed such that if a manufacturer rents a larger or smaller space in a different trade show or other event, it is not possible to change the overall size or configuration of the display assembly to meet the needs of the particular occasion.

Accordingly, there is a need in the display assembly art for a lightweight, yet sturdy display assembly which is adapted to be easily and quickly assembled and disassembled for transport while also being strong enough to display relatively heavy articles of display thereon. There is a further need in the present art for a portable display assembly which is adapted to be easily assembled to form a display wall of virtually any desired size, shape or configuration.

Applicant's invention is directed to a substantially lightweight frame structure which, while it does not pop-up into place like many other designs, may be fully assembled in substantially the same time needed for the elaborate tightening and securing procedures required by the pop-up assemblies. Applicant's invention utilizes spaced apart vertical frame units which are interconnected to form a display structure of varying lengths and varying configurations. The resulting display wall structure of the applicant's invention is sturdy enough to support heavier items such as computers, televisions, camera equipment, clothing, and the like, may be displayed on the portable display assembly, something which is not possible with the other portable display devices in the related art.

SUMMARY OF THE INVENTION

Accordingly, it is a principal object of the present invention to provide a display assembly which is adapted to be easily assembled and disassembled using a number of lightweight interconnecting component parts so as to form a display wall structure of any desired size, shape or configuration in accordance with the needs and desires of the user.

It is another object of the present invention to provide a portable, lightweight display assembly which can be easily disassembled and stored in one or several carry cases, thereby facilitating transport between use locations.

It is a further object of the present invention to provide a display assembly which is adapted to support a number of substantially heavy display items thereon.

It is yet a further object of the present invention to provide a display assembly which can be easily assembled in a relatively short period of time.

With these and other objects and advantages in mind, the present invention is directed towards a portable display assembly for use at a trade show, seminar, or like events, which is capable of being assembled in a variety of sizes and configurations upon which a variety of substantially heavy display materials may be placed. The portable display assembly includes four major component parts which are lightweight and adapted to be assembled to form a display wall frame structure of virtually any desired size, shape or configuration. The component parts include a lower frame section, an upper frame section, scissor connectors, and telescopic brace bars. The lower frame section, which has a generally H-shaped configuration, includes a pair of upper stanchions designed and configured to receive lower stanchions on the bottom of a generally H-shaped upper frame section, thereby forming a full height vertical frame unit. The vertical frame units are attached to one another by means of scissor connectors, which include a pair of elongate, rigid elements pivotally interconnected at mid-sections thereof to form two pair of oppositely disposed scissor arms. The scissor connectors have a pair of apertures at each distal end of the four scissor arms, which are designed to be easily fitted onto pegs in the lower frame section and the upper frame section. The positioning of the apertures on the scissor arms is specifically calculated so as to position adjacent, interconnected frame units in either parallel relation or an angled relation to one another to create either a straight or a curved wall section. In addition to the scissor connectors, telescopic brace bars may be adjusted to a desired length and attached diagonally between adjacent frame units to provide additional support in a plurality of locations. In such a manner, the frame units may be positioned and oriented to form a wall frame structure of the desired length, height, and configuration. The upper frame sections and the lower frame sections include a plurality of notches along their respective lengths, structured and disposed to receive shelving brackets or the like upon which a substantially varied array of display items may be positioned.

The component pieces are designed to be substantially lightweight and easy to assemble, and may be easily stored or transported in one or a plurality of carry cases. Accordingly, the same portable display assembly may be utilized and adaptively oriented at numerous trade shows or the like.

The features of construction, combination of elements, and arrangement of parts of the present invention will be more readily apparent from the description which follows and the scope of the invention will be defined in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
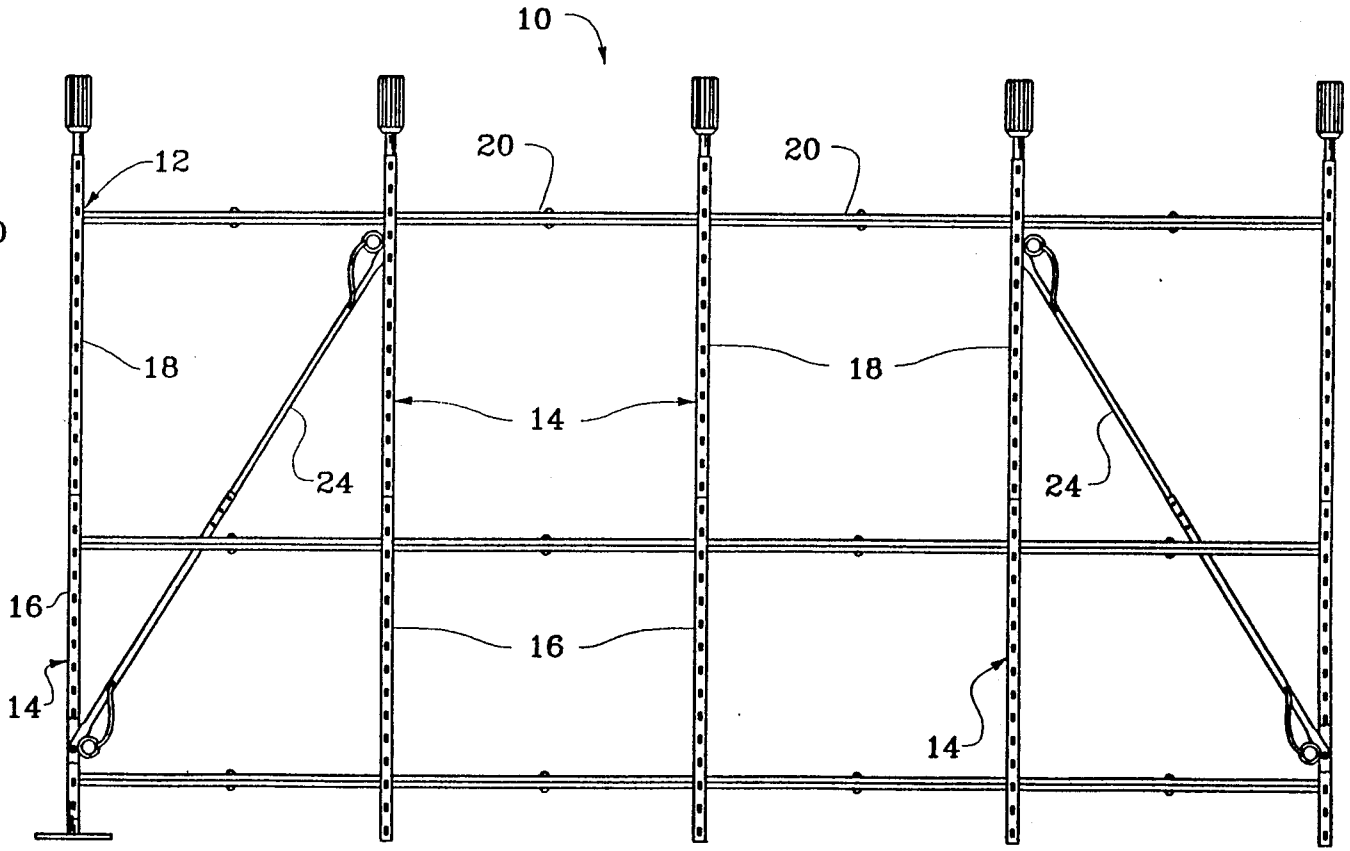
FIG. 2 is a side elevation view of the display assembly of FIG. 1.
Figure 1:
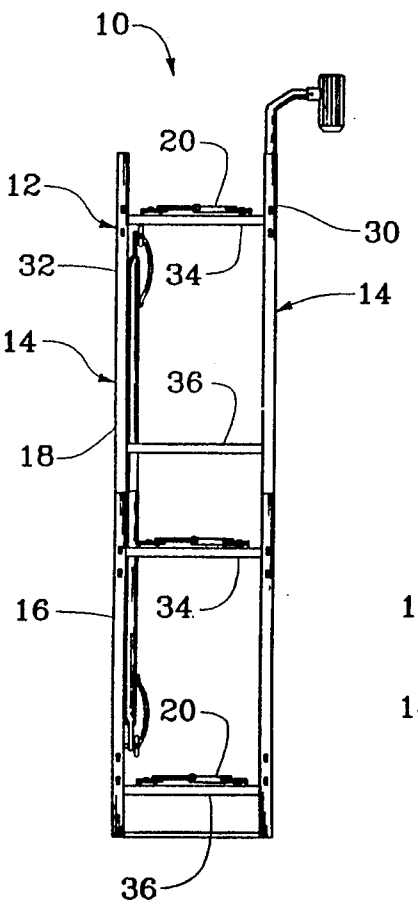
FIG. 1 is a front elevation of a preferred embodiment of the display assembly of the present invention.

Referring initially to FIGS. 1 and 2, there is illustrated a wall frame structure 12 of a display assembly of the present invention, which is generally indicated as 10. The wall frame structure 12 includes a plurality of vertically oriented frame units 14 disposed in spaced apart, substantially parallel relation to one another. Each of the vertically oriented frame units 14 include a lower frame section 16 and an upper frame section 18 structured for interconnection with one another to form a full height frame unit associated with the assembly of the display assembly 10. Each of the frame units 14 are adapted to be interconnected with a next adjacent frame unit 14 using scissor connectors 20 which interconnect between corresponding upper frame sections 18 and lower frame sections 16 of adjacent frame units 14. The scissor connectors 20 are specifically structured to position adjacent frame units in one of a plurality of orientations according to a desired wall configuration of the wall frame structure 12.

As best seen in FIG. 2, each of the lower frame sections 16 and upper frame sections 18 include a front vertical rail 30 and a rear vertical rail 32 extending in parallel relation to one another and interconnected by upper and lower cross bars 34 and 36 extending in generally perpendicular relation therebetween. The scissor connectors 20 are specifically structured for attachment to the upper and lower cross bars 34, 36 of adjacent frame units 14, as will be explained in greater detail hereinafter.

In the preferred embodiment, several telescopically adjustable brace bars 24 are each interconnected between two adjacent frame units 14, preferably at opposite ends of the wall frame structure 12, to provide additional stability and support to the assembly 10. The brace bars 24 are telescopically adjustable in length and attach to the back rails 32 of adjacent frame units 14, with one end of the brace bar 24 connecting near a bottom end of a lower frame section 16 and the opposite end of the brace bar 24 connecting near a top of an upper frame section 18 of an adjacent frame unit 14, as will be described in greater detail hereinafter. Additionally, the brace bars 24 can be reduced in length and connected diagonally between two adjacent lower frame sections 16 when a half height wall section is desired.

Figure 3:
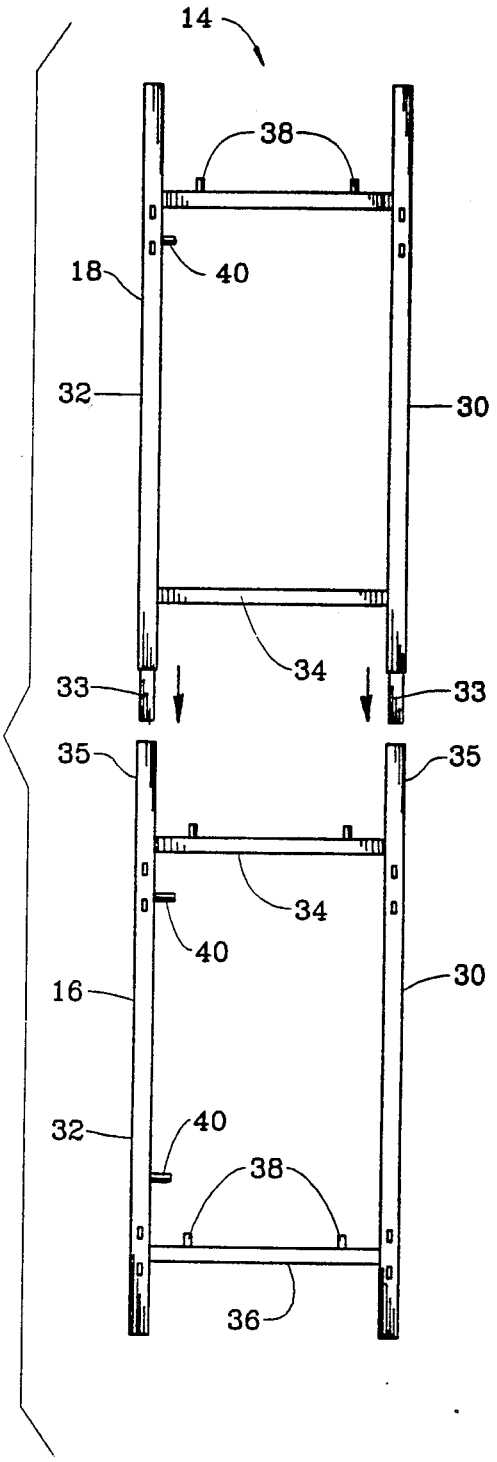
FIG. 3 is an exploded plan view of a frame unit of the present invention including an upper frame section and a lower frame section.
Figure 5:
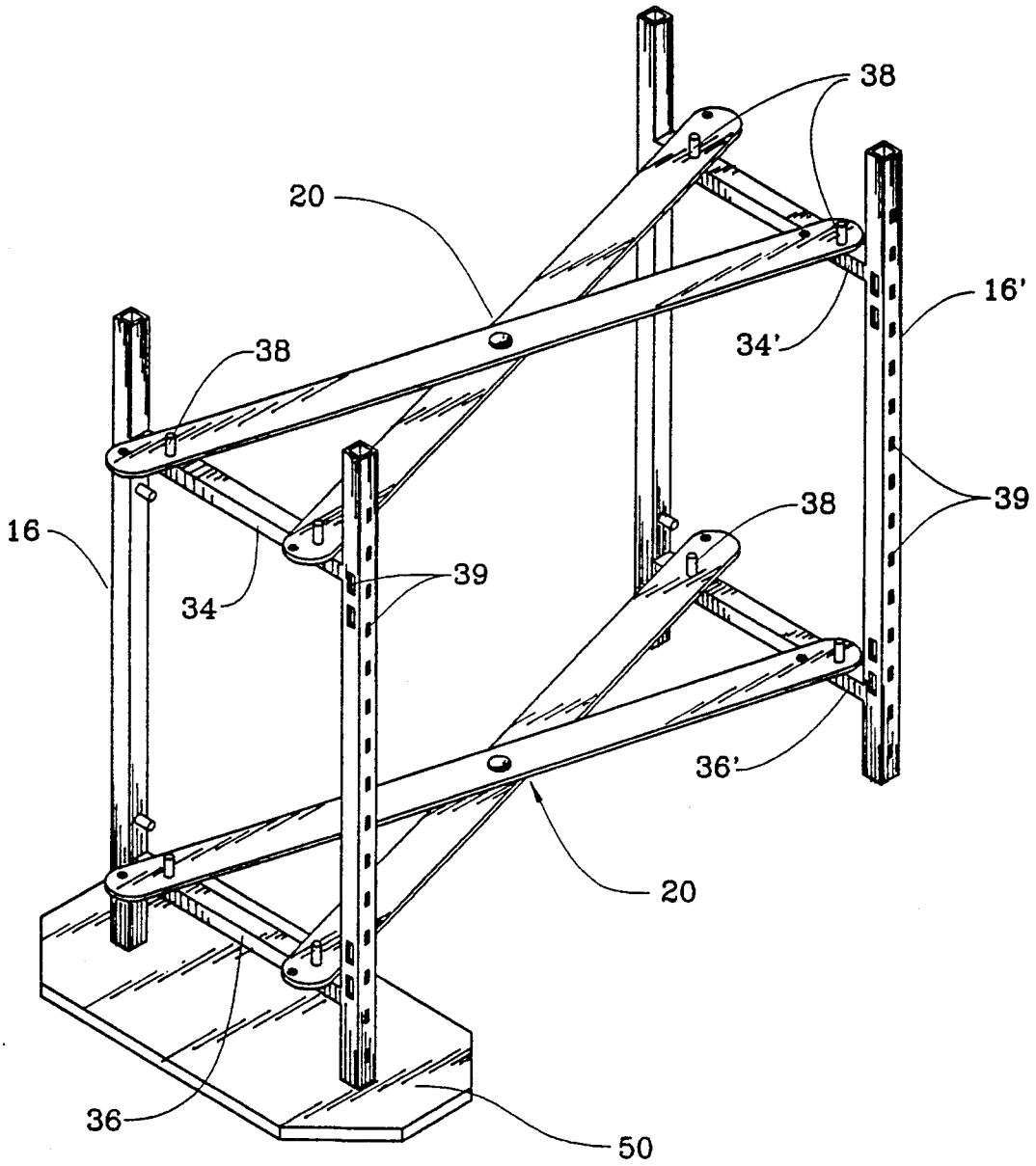
FIG. 5 is a perspective view illustrating a portion of the display assembly and particularly the interconnection of two lower frame sections using the scissor connectors.

With reference to FIGS. 3 and 5, it can be seen that the frame units 14, including the upper frame sections 18 and lower frame sections 16 are formed of a generally square hollow metal tubing having four distinct sides. The bottom distal ends 33 of the front 30 and back 32 rails have a reduced dimension so as to facilitate sliding insertion and receipt into the top ends 35 of the hollow front and back rails 30 and 32 of the lower frame section 16. Each of the upper and lower cross bars 34, 36 on the frame sections 16, 18 include a pair of pegs 38 extending from a top surface thereof in spaced apart relation. The pegs 38 are specifically structured to facilitate attachment of the scissor connectors 20 to be discussed hereinafter. A second pair of pegs 40 extend from an inner surface of the back rails 32 on both the upper and lower frame sections 18, 16 to facilitate attachment of the brace bars 34.

The front and rear rails 30 and 32 of the upper and lower frame sections 18, 16 include a series of notches equally spaced along a length thereof on opposite side surfaces. The front rails 30 also include the notches 39 along a front surface thereof, as best illustrated in FIG. 5. The notches 39 are specifically sized and configured for supporting receipt of attachment prongs or fingers of conventionally-known brackets, such as shelf brackets. In this manner, shelf brackets, clothing rail brackets, or other accessories can be attached to the frame units 14 of the wall frame structure 12 to support various articles of display thereon as desired.

As seen in FIG. 5, assembly of the wall frame structure 12 begins with detachment of two adjacent lower frame sections 16, 16' using the scissor connectors 20. In the preferred embodiment, a support plate 50 is attachable to the bottom ends of the front and back rails 30, 32 of the lower frame section 16 so as to provide additional stability and support while trying to position and orient the two lower frame sections 16, 16'.

Figure 4:
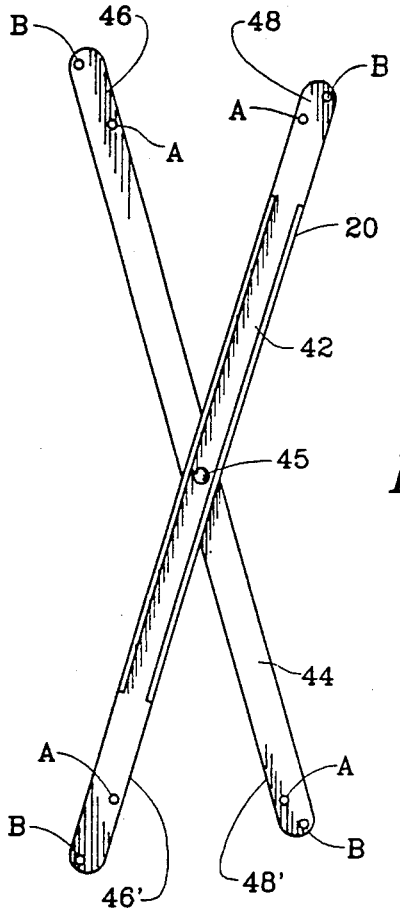
FIG. 4 is a top plan view of a scissor connector of the present invention.
Figure 7:
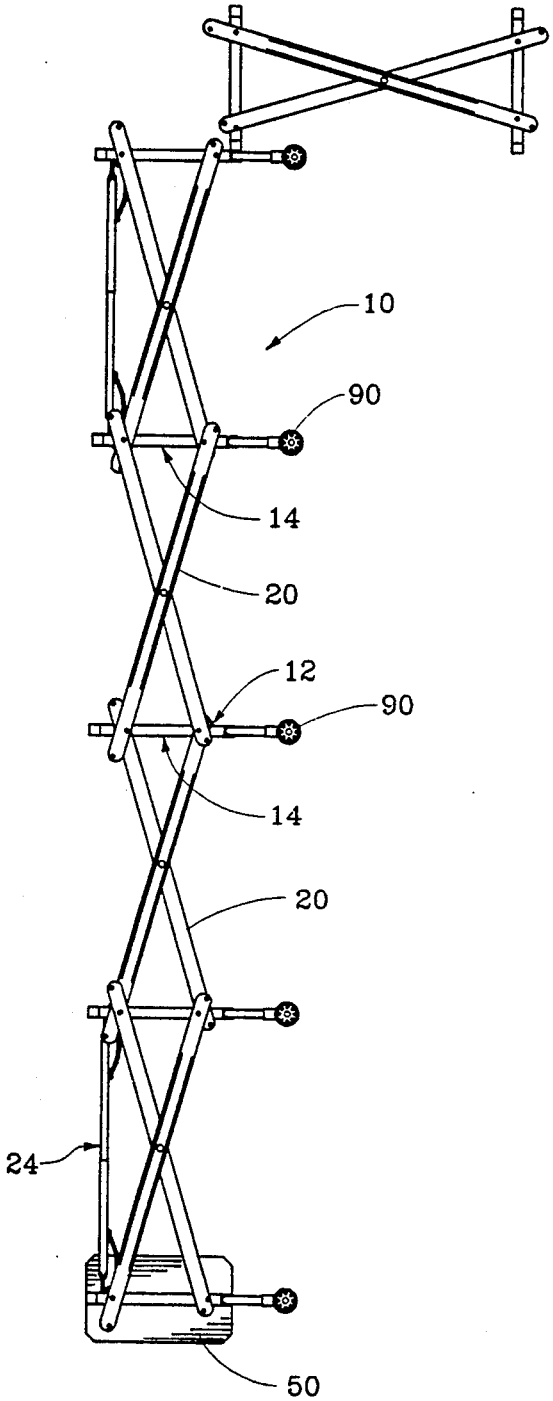
FIG. 7 is a top plan view of a preferred embodiment of the display assembly shown assembled in a generally linear orientation.
Figure 8:
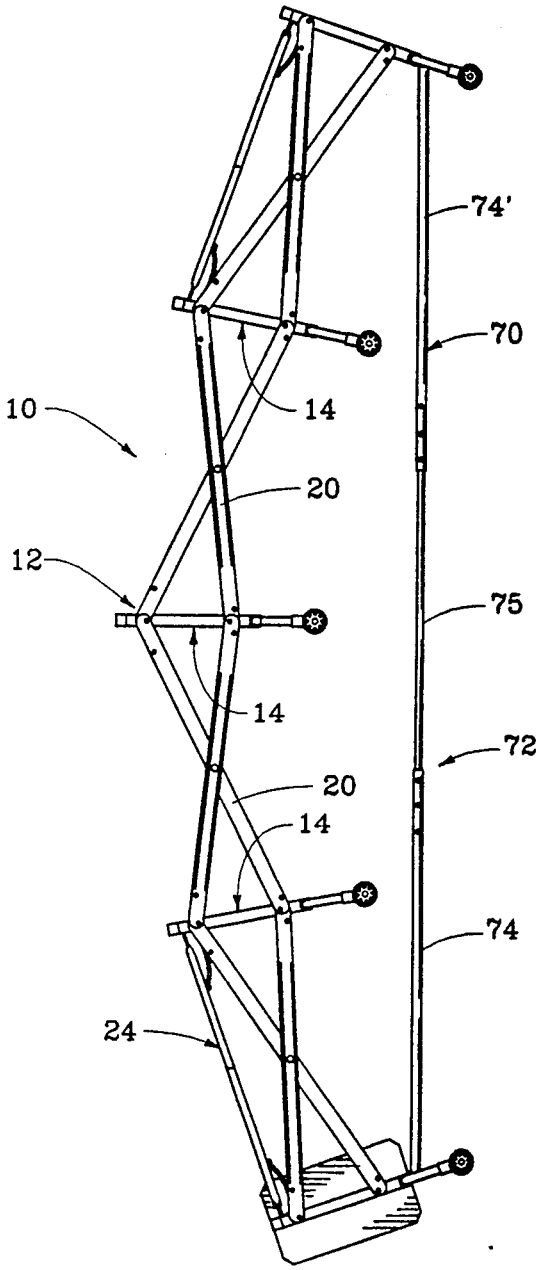
FIG. 8 is a top plan view of the display assembly shown assembled in a generally curvilinear configuration.

An important feature of the present invention is the scissor connectors 20, and as seen in FIG. 4, each of the scissor connectors 20 includes a pair of elongate, rigid, substantially flat bars 40, 42 which are pivotally connected as at 45 near their mid-sections so as to form opposite pairs of scissor arms 46, 48 and 46', 48' on opposite sides of the pivotal connection 45. The distal ends of each of the scissor arms 46, 48 and 46', 48' each include a pair of apertures A,B formed therein. The location of the apertures A,B on each of the scissor arms is critical in that it ultimately determines the relative positioning of two adjacent frame units 14, and in turn, defining the resulting configuration of the wall frame structure. The apertures A,B are specifically sized and configured for receipt of the pegs 38 therethrough to facilitate interconnection between corresponding upper frame sections 18, and lower frame sections 16 of adjacent frame units 14. When assembling the wall frame structure 12 of the display assembly 10 of the present invention, it is necessary to consider the desired wall configuration of the display so that the proper assembly can be achieved. While it is the relative positioning of adjacent frame units 14 that determines the configuration of the wall structure 12, it is the manner of attachment of the scissor connectors 20 between adjacent frame units 14 which actually determines the relative positioning of the frame units 14. Specifically, attachment of the scissor connectors 20 so that the pegs 38 pass through apertures A results in adjacent frame units 14 being positioned in generally parallel relation to one another resulting in a generally straight or linear wall configuration as seen in FIG. 7. Alternatively, placement of the pegs 38 through apertures B result in positioning the adjacent frame units 14 in an angled orientation relative to one another resulting in a curvilinear wall as seen in FIG. 8. By flipping the scissor connector 20 over and inserting the pegs 38 through apertures B on the opposite side, the relative positioning of adjacent frame units 14 is changed so as to angled in an opposite direction from that illustrated in FIG. 8 such that the resulting wall structure curves in an opposite direction. Therefore, it can be seen from the above description, that the resulting wall structure can be made to change direction between each of two adjacent frame units. Thus, virtually any desired wall configuration could be achieved including a wall structure having a straight section and curvilinear sections. Additionally, the wall structure 10 can be directed in a serpentine configuration wherein the wall curves in one direction and by simply inverting the scissor connectors, the wall structure can be caused to curve in an opposite direction between the next succeeding adjacent frame units 14.

Figure 6:
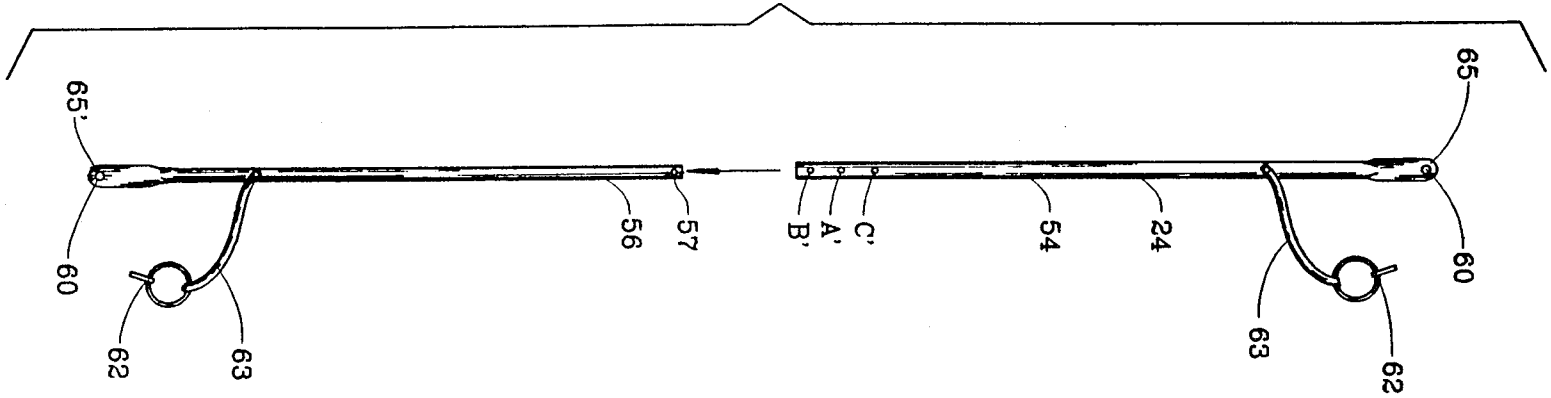
FIG. 6 is a top plan view of a telescopically adjustable brace bar of the present invention.

The telescopically adjustable brace bar 24 is seen in FIG. 6 and includes a first tubular section 54 and a second tubular section 56. The second section 56 is of a lesser cross-sectional dimension than the first section 54 so as to be telescopically slidable through a hollow interior of the first section 54 along a length thereof. As mentioned earlier, the brace bar 24 is adjustable in length and is generally connected in a diagonal fashion between adjacent frame units 14 with one end attached near a bottom of a lower f rame section and the opposite end attached near a top of an upper frame section of an adjacent frame unit. Each of the opposite ends 65 of the brace bar 24 includes an aperture 60 formed therein adapted to receive peg 40 on the back rail 30 therethrough. When it is desired to connect the brace bar 24 between two full height adjacent frame units including both upper and lower sections 18, 16, the brace bar would be extended to a full length position. However, depending upon the relative positioning of the adjacent frame units 14, it is necessary to adjust the exact length of the brace bar 24 to accommodate for different distances of separation between the adjacent frame units 14. Specifically, when adjacent frame units 14 are to be positioned in generally parallel relation (i.e. when forming a straight wall portion), the second section 56 of the brace bar 24 would be inserted into the first section 54 so that a full length adjustment button 57 is locked into position in hole A' on the first section 54. Likewise, if the adjacent frame sections 14 are to be angled inwardly toward one another, the brace bar 24 will have to be slightly lengthened and thus adjustment button 57 would be positioned in hole B'. If the adjacent frame sections 14 are to be angled away from one another, resulting in a curved wall in an opposite direction, the button 57 is locked into hole C'.

It may be desired to form a half height wall section in which only the lower frame sections 16 would be used. In this instance, it is necessary to shorten the overall length of the brace bar 24 so as to extend between a top end of one lower frame section 16 and a bottom end of a next adjacent lower frame section 16 in a diagonal fashion. To shorten the overall length of the brace bar 24, the second section 56 is inserted within the first section 54 so as to telescopically slide substantially along a length thereof until a half length adjustment button 58 is engaged in one of the holes A', B', C', in accordance with the desired wall configuration, as discussed above.

Figure 10:
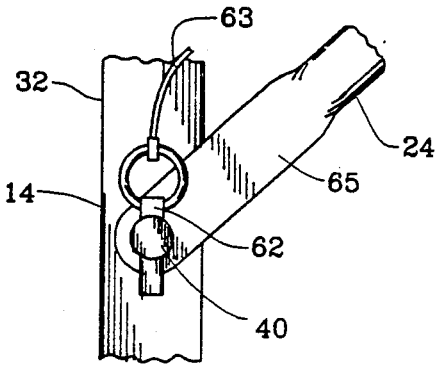
FIG. 10 is an isolated plan view illustrating interconnection of one end of the brace bar to a frame unit.

Once the apertures 60 on the opposite ends of the brace bar 24 are fitted to pegs 40, a locking pin 62 is inserted through peg 40 at each end to prevent dislodging or accidental removal, as illustrated in FIG. 10. A locking pin 62 is secured to each end of the brace bar 24 using an interconnecting cable 63.

An additional feature of the present invention is a valance assembly including an upper valance bar 70 and a lower valance bar 70' which are attachable between two upper frame sections 18 so as to extend in substantially parallel relation to one another across a portion or the entire length of the display assembly 10. The valance assembly provides added dimension to the display assembly 20 adding to the dramatic effect of lighting as well as providing an ideal surface to place a manufacturer's logo or other signage. The resulting valance assembly can be seen in FIG. 17 extending substantially across the top of the display assembly between opposite ends thereof.

Figure 9:
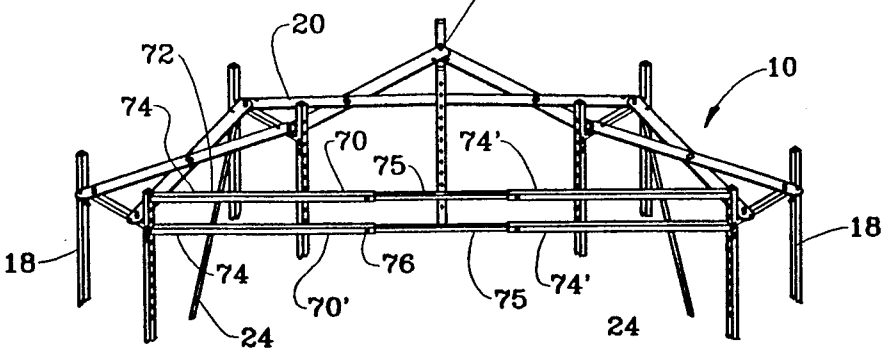
FIG. 9 is an isolated view, shown in perspective, illustrating attachment of upper and lower valance bars to the display assembly.
Figure 11:
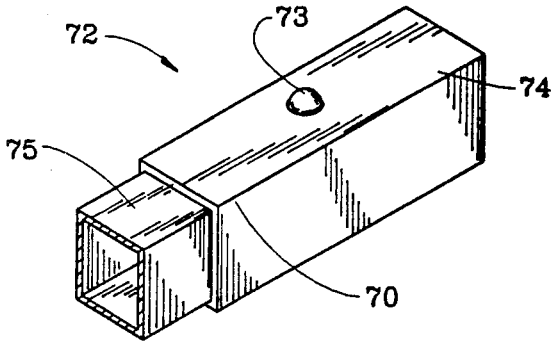
FIG. 11 is an isolated plan view illustrating a telescopically adjustable structure of the valance bars.

As seen in FIG. 9, each of the valance bars 70, 70' includes opposite end sections 74, 74' which are attachable at their distal ends to a top portion of the upper frame sections 18. Extending between the opposite end sections 74, 74' of each valance bar 70, 70' is a center section 75 which is telescopically fitted at opposite ends within the end sections 74, 74' so as to extend therebetween. The overall length of the upper and lower valance bars 70, 70' can be adjusted by sliding movement of the center section 75 along the interior length of the opposite end sections 70, 74'. Spring bias locking buttons on opposite ends of the center section 75 are adapted to lock the center section into place within the end sections 74, 74' by positioning the buttons 80 within one of a plurality of adjustment holes 76 on the end sections 74, 74', as best illustrated in FIG. 11.

Figure 12:
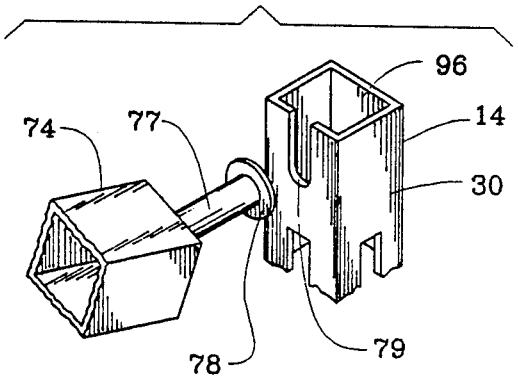
FIG. 12 is an isolated view shown in perspective illustrating the means of attachment of the upper valance bar to the frame units of the display assembly.
Figure 12A:
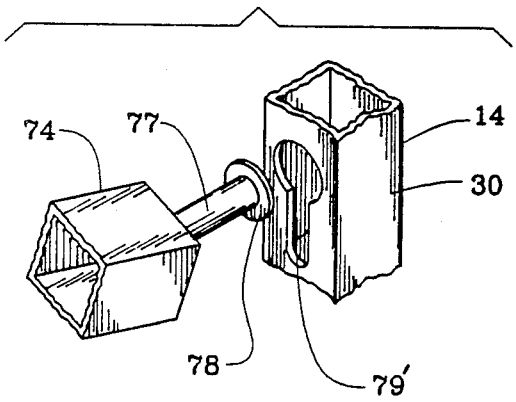
FIG. 12A is an isolated view shown in perspective illustrating the means of attachment of the lower valance bar to the frame units of the display assembly.
Figure 13:
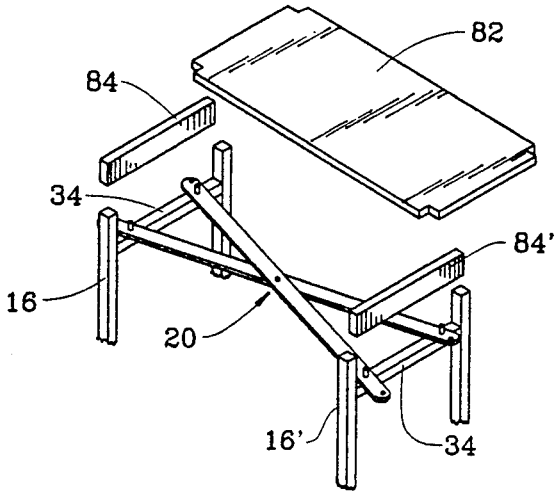
FIG. 13 is an exploded view, shown in perspective, illustrating attachment of a shelf surface between two frame units of the present invention.

As seen in FIGS. 12 and 12A, the free distal ends of the end sections 74, 74' of the valance bars 70, 70' are fitted with studs 77 having a flanged head 78. The studs 77 are specifically structured for sliding receipt within a slot 79 or 79' formed on the top of rail 30 of each of the upper frame sections 18. The flanged head 78 is adapted to mate with an interior surface with the rail 30 preventing withdrawal of the stud 77 from the slot 79 or 79' once fitted therein. In this manner, the end sections 74, 74' of the upper and lower valance bars 70, 70' can be easily attached near the top of rail 30 on any of the upper frame sections 18. The lower slot 79' is preferably spaced between 6–12 inches below the upper slot 79 thus defining the spacing between the upper and lower parallel valance bars 70, 70'.

Another additional feature of the present invention is a shelf 82 which can be fitted between two adjacent frame sections, such as two lower adjacent frame sections 16, 16'. A pair of spacer elements 84, 84' are adapted to be fitted to the top of the upper cross bars 34 to provide a mounting surface for the shelf 82. Accordingly, the shelf 82 will rest along opposite ends on the spacer elements 84, 84' in spaced relation above the scissor connector 20 between two adjacent lower frame sections 16, 16'.

Figure 14:
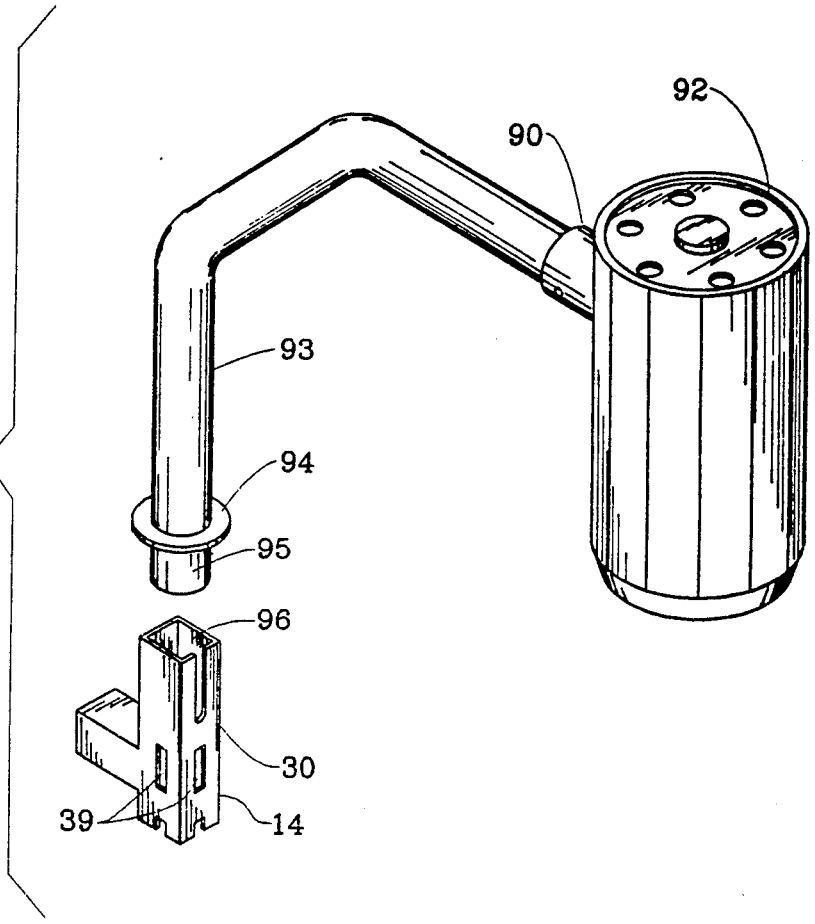
FIG. 14 is an isolated view, shown in perspective, illustrating attachment of light fixtures to the display assembly of the present invention.

A light assembly for use in combination with the present invention is shown in FIG. 14 and includes a light fixture generally indicated as 90 having a light housing 92 with a light source such as a light bulb therein. Extending from the light housing 92 is an extension arm 93 having a distal end 95 specifically sized for receipt with an open top end 96 of rail 30 on an upper frame section 18. A stopper element 94 is specifically designed to engage the top of the front rail 30 so as to support the extension arm 93 and light housing 92 in a preferred orientation on the top of the assembly 10.

Figure 15:
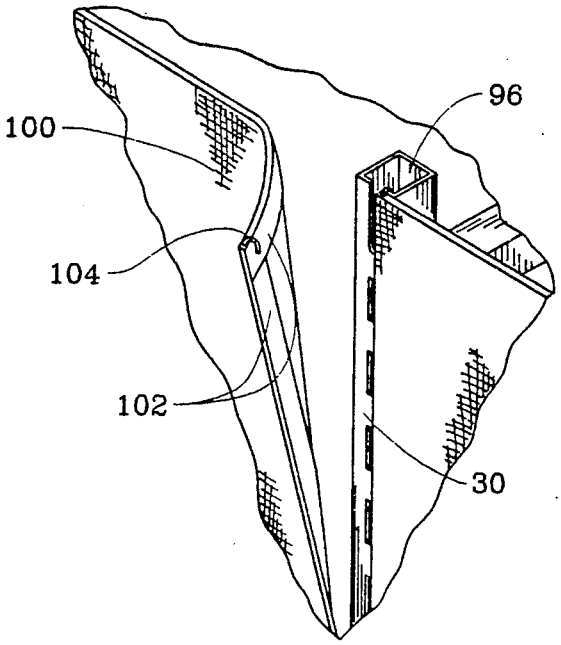
FIG. 15 is an isolated view, shown in perspective, illustrating attachment of decorative panels to the display assembly of the present invention.
Figure 17:
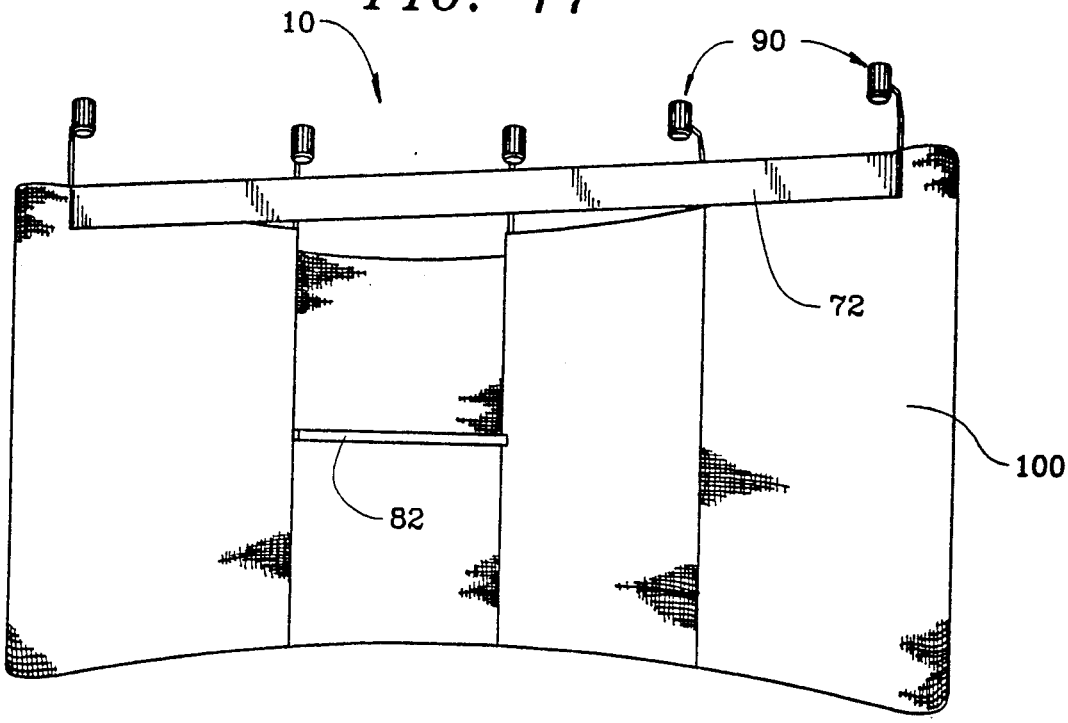
FIG. 17 is a front elevation of a completed display assembly in a preferred embodiment of the present invention.

With reference to FIG. 15, attachment of decorative panels 100 to an exposed front face of the wall frame structure 12 is illustrated. Specifically, the decorative panels 100 are preferably formed of a felt or light carpet material and include magnetic strips 102 fitted around an inner peripheral edge as seen in FIG. 15. The magnetic strips 102 are adapted for magnetic engagement with an exposed surface of rails 30, 32 on the frame units 14 so as to cover the wall frame structure 12 and provide a decorative wall surface as best seen in FIG. 17. The panels further include a hook 104 on their opposite top ends adapted for hooking engagement over the open top 96 of the rails 30 of the frame units 14.

Figure 16:
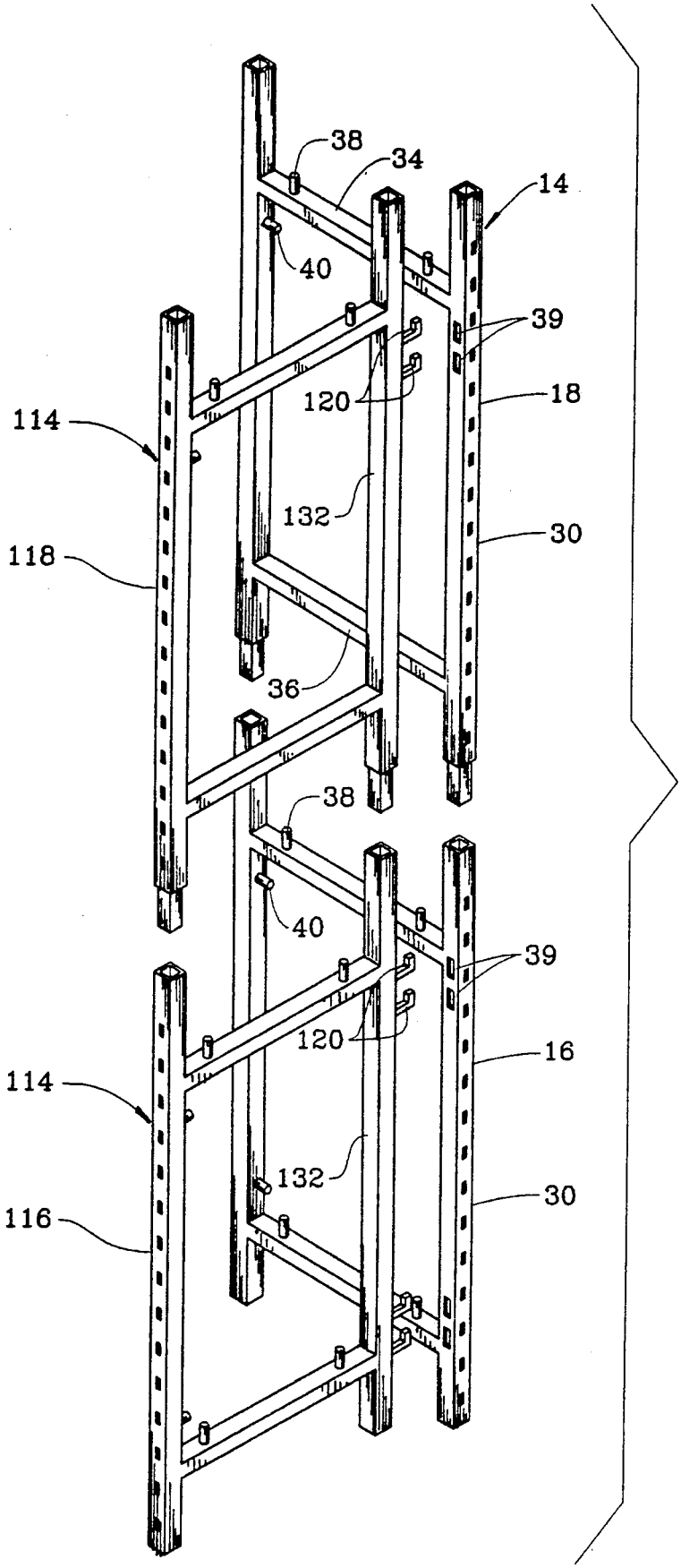
FIG. 16 is an exploded view, shown in perspective, illustrating attachment of additional frame units, including an additional upper frame section and an additional lower frame section to the frame units of the display assembly of the present invention.

With reference to FIG. 16, additional frame units such as 114 are provided for adding to wall frame structure 12 so as to add on a wall structure extending generally perpendicular to wall frame structure 12. The additional wall frame units 114 include a lower frame additional section 116 and an upper frame additional section 118 which are similar in construction as upper and lower frame sections 18 and 16 as discussed above. The additional frame sections 118 and 116 further include fingers 120 extending from rail 132 which are adapted for receipt within corresponding notches 39 for attachment of the additional frame unit to a vertical frame unit 14 at an end of the wall frame structure 12.

Figure 18:
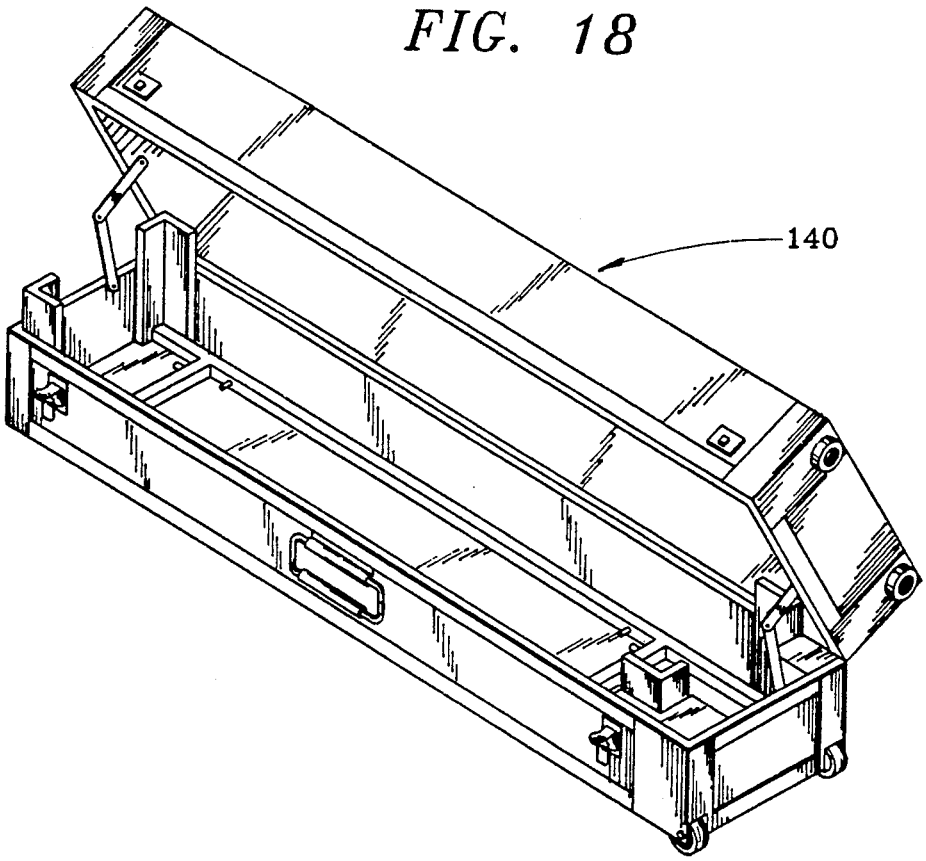
FIG. 18 is a perspective view illustrating a carry case used f or carrying various disassembled components of the display assembly of the present invention.

FIG. 18 illustrates a carry case for use in connection with carrying disassembled components of the display assembly of the present invention.

Now that the invention has been described,

What is claimed is:

1. A portable display assembly comprising:

a plurality of vertical frame units, positioning means structured for removable interconnection between adjacently positioned vertical frame units so as to form a wall structure, said positioning means being structured and disposed to selectively position said adjacently positioned frame units in either a parallel orientation or one of a plurality of angled orientations relative to one another so as to define one of a plurality of configurations of said wall structure, said positioning means comprising a pair of elongate, rigid elements pivotally connected in midcentral zones thereof, and panel means for providing a decorative wall surface, said panel means being removably attachable to an exposed vertical face of said wall structure.

2. A portable display assembly as recited in claim 1 wherein said plurality of vertical frame units each include an upper frame section and a lower frame section.

3. A portable display assembly as recited in claim 2 wherein said upper frame section is structured to be adaptively fitted to a top end of said lower frame section.

4. A portable display assembly as recited in claim 3 wherein said lower frame section has a bottom end structured for supporting engagement with a support surface.

5. A portable display assembly as recited in claim 1 wherein said positioning means includes at least one connector element between said lower frame sections of said attached adjacently positioned frame units.

6. A portable display assembly as recited in claim 5 wherein said positioning means includes one of said connector elements attached to adjacently positioned ones of said upper frame sections.

7. For use in supporting articles for display thereon, a portable display assembly adapted to be assembled and erected to form a substantially vertically oriented wall structure having opposite vertical wall faces, said portable display assembly comprising:

a plurality of lower frame sections each having a top end and a bottom end, said bottom end structured for supporting engagement with a support surface, a plurality of upper frame sections each including a bottom end structured and configured for attachment to said top end of a corresponding lower frame portion to form one of a plurality of frame units, positioning means structured to be removably interconnected between adjacently positioned frame units so as to position said adjacent frame units in either a parallel or one of a plurality of angled orientations relative to one another for defining one of a plurality of wall configurations, said positioning means including a plurality of scissor connectors structured for removable interconnection between adjacently positioned ones of said frame units for relative positioning thereof, each of said scissor connectors including a pair of elongate, rigid elements pivotally interconnected at mid-sections thereof so as to include oppositely disposed pairs of scissor arms, wherein a first pair of said scissor arms is attachable to one of said frame units and an opposite second pair of said scissor arms is attachable to a next adjacent one of said frame units, brace means structured for diagonal interconnection between said adjacently positioned frame units for providing support therebetween and preventing relative movement between said adjacently positioned frame units, and panel means for providing a decorative wall surface, said panel means being removably attachable to said vertical wall faces of said wall structure.

8. A portable display assembly as recited in claim 7 wherein said lower frame section includes a generally H-shaped configuration with a pair of parallel stanchions extending from said bottom end and said top end thereof.

9. A portable display assembly as recited in claim 8 wherein said upper frame section includes a generally H-shaped configuration with said bottom end including a pair of parallel stanchions being sized and configured for attachable receipt within the stanchions on said top end of said lower frame portion.

10. A portable display assembly as recited in claim 7 wherein said brace means includes telescopically extendable brace bars structured and disposed for diagonal interconnection between said adjacently positioned frame units from near the top end of said upper frame section of one of said frame units to near the bottom end of said lower frame section of said next adjacent frame unit.

11. A portable display assembly adapted to be assembled and erected to form a substantially vertically oriented wall structure, said portable display assembly comprising:

a plurality of lower frame sections each having a generally H-shaped configuration with a pair of parallel stanchions extending from a top end and a bottom end thereof, said bottom end being structured for supporting engagement with a support surface, a plurality of upper frame sections each having a generally H-shaped configuration with a bottom end including a pair of parallel stanchions being sized and configured for attachable receipt within the stanchions on said top end of said lower frame portion, a plurality of frame units each being defined by an attached pair of said lower and upper frame sections, said upper frame sections and said lower frame sections each including a pair of cross bars extending between and connecting to a front stanchion and rear stanchion thereof, a plurality of scissor connectors structured for removable interconnection between adjacently positioned frame units for relative positioning thereof, said scissor connectors each including a pair of elongate, rigid elements pivotally interconnected at mid-sections thereof so as to include oppositely disposed pairs of scissor arms wherein a first pair of said scissor arms is attachable to one frame unit and an opposite second pair of said scissor arms is attachable to a next adjacent frame unit, said scissor connectors being structured and disposed for selective positioning said adjacent frame units in either a parallel orientation or one of a plurality of angled orientations relative to one another, thereby defining one of a plurality of wall configurations, each of said cross bars including a pair of pegs positioned in spaced relation on an upper surface of said cross bars, each of said scissor connectors including a first set of apertures and a second set of apertures at distal ends of each of said respective pair of scissor arms, said first set of apertures including one aperture on each of said distal ends of said first and said second pair of said scissor arms, said first set of apertures being structured and disposed to be selectively positioned over said pair of pegs on said upper surface of said cross bar in said adjacent frame units, such that said frame units are positioned in generally parallel relation to one another, said second set of apertures including one aperture on each of said distal ends of said first and said second pair of said scissor arms, said second set of apertures being structured and disposed to be selectively positioned over said pair of pegs on said upper surface of said cross bar in said adjacent frame units, such that said frame units are positioned in generally angled relation to one another, telescopically extending brace bars structured for diagonal interconnection between said adjacently positioned frame units for providing support therebetween and preventing relative movement of said frame units, and panel means for providing a decorative wall surface, said panel means being removably attachable to said stanchions along an exposed vertical face of said wall structure.

12. A portable display assembly as recited in claim 11 wherein said stanchions at said bottom end of said lower frame section are adapted to be fitted within a support plate.

13. A portable display assembly as recited in claim 11 wherein said upper frame structure includes a pair of stanchions at a top end thereof, which are adapted to receive lighting units.

14. A portable display assembly as recited in claim 11 wherein said frame units include a plurality of notches extending along lengths thereof, which are adapted to receive bracket supports therein.

15. A portable display assembly as recited in claim 14 wherein said bracket supports are adapted to hold a shelve, cross bar, or like support means.

16. A portable display assembly as recited in claim 11 wherein said telescopically extending brace bars include an outer bar and an inner bar.

17. A portable display assembly as recited in claim 16 wherein said outer bar includes a row of spaced holes at opposite distal ends thereof.

18. A portable display assembly as recited in claim 17 wherein said inner bar is structured to be fitted within said outer bar, and includes a spring biased locking button at opposite distal ends thereof, being structured and disposed for releasable securement within one of said holes on said outer bar so as to secure said telescopically extending brace at a desired length.

19. A portable display assembly as recited in claim 11 wherein said lower frame sections, said upper frame sections, said scissor connectors, said telescopically extending brace bars, and said panel means may be stored within one or a plurality of carrying cases.

20. A portable display assembly comprising:

a plurality of vertical frame units, positioning means structured for removable interconnection between adjacently positioned vertical frame units so as to form a vertical wall structure having opposite vertical faces, said positioning means structured and disposed to selectively position said adjacently positioned frame units in either a parallel orientation or one of a plurality of angled orientations relative to one another so as to define one of a plurality of configurations of said wall structure, said positioning means including a plurality of scissor connectors structured for removable interconnection between adjacently positioned ones of said frame units, each of said scissor connectors including a pair of elongate, rigid elements pivotally interconnected at mid-sections thereof so as to include oppositely disposed pairs of scissor arms wherein a first pair of said scissor arms is attachable to one of said frame units and an opposite second pair of scissor arms is attachable to a next adjacent one of said frame units for relative positioning thereof, and panel means for providing a decorative wall surface, said panel means being removably attachable to said vertical faces of said wall structure.

* * * * *